US008679613B2

(12) United States Patent
Kopan

(10) Patent No.: US 8,679,613 B2
(45) Date of Patent: Mar. 25, 2014

(54) ARMOR HAVING A BALLISTIC COMPOSITE WRAP SLIP LAYER AND A LAMINATE CONTAINMENT WRAP

(75) Inventor: Brian Richard Kopan, Corona Del Mar, CA (US)

(73) Assignee: Ceradyne, Inc., Costa Mesa, CA (US)

( * ) Notice: Subject to any disclaimer, the term of this patent is extended or adjusted under 35 U.S.C. 154(b) by 1845 days.

(21) Appl. No.: 11/805,190

(22) Filed: May 21, 2007

(65) Prior Publication Data

US 2013/0319214 A1 Dec. 5, 2013

(51) Int. Cl.

| | |
|---|---|
| ***B32B 5/12*** | (2006.01) |
| ***B32B 23/02*** | (2006.01) |
| ***B32B 27/04*** | (2006.01) |
| ***B32B 27/12*** | (2006.01) |

(52) U.S. Cl.
USPC ..... 428/105; 428/192; 428/911; 442/134; 442/135

(58) Field of Classification Search
USPC ..... 109/78, 79, 80; 89/36.02, 36.04; 442/134, 135; 428/911, 105, 192; 52/309.1, 650, 250, 203
See application file for complete search history.

(56) References Cited

U.S. PATENT DOCUMENTS

| | | | | |
|---|---|---|---|---|
| 4,292,882 | A * | 10/1981 | Clausen | 428/911 |
| 4,550,044 | A * | 10/1985 | Rosenberg et al. | 428/911 |
| 4,639,387 | A * | 1/1987 | Epel | 428/911 |
| 4,739,690 | A * | 4/1988 | Moskowitz | 428/409 |
| 6,475,936 | B1 * | 11/2002 | Chiou | 428/911 |
| 2006/0037463 | A1 * | 2/2006 | Vittoser et al. | 89/36.02 |
| 2008/0092731 | A1 * | 4/2008 | Hall | 89/36.04 |

* cited by examiner

*Primary Examiner* — Elizabeth Cole
*Assistant Examiner* — Jeremy R Pierce
(74) *Attorney, Agent, or Firm* — C. Michael Geise

(57) ABSTRACT

This invention relates to the use of an open, plain Leno Aramid fiber weave wrapped around the armor base plate in such a fashion that the wrap on the strike face surface is bonded with a thermoset resin while the continuous fibers around the back are left resin-free and able to distort, allowing localized deformation while keeping the remainder of the "wrap" holding tight. This wrap technique keeps the composite backing tight to the strike surface while allowing all of the benefits of localized fiber movement and tensile failure on the backside of the target. Other high performance fibers, such as fiberglass, also woven in a Leno weave and applied in the same method will yield similar results. This invention also relates to the placement of a "slip layer" between the fiber surface and the polymer coating of an armor system. This layer, consists of Teflon, silicone, or other low friction, bonding resistant materials, and prevents intimate bonding of the polymer coating to the fiber back and allows a low friction slip surface that isolates the polymer from the trauma of fiber deformation and breakage.

9 Claims, 3 Drawing Sheets

ARMOR HAVING A BALLISTIC COMPOSITE WRAP SLIP LAYER AND A LAMINATE CONTAINMENT WRAP

This invention relates to the use of an open, plain Leno Aramid fiber weave wrapped around the armor base plate in such a fashion that the wrap on the strike face surface is bonded with a thermoset resin while the continuous fibers around the back are left resin-free and able to distort, allowing localized deformation while keeping the remainder of the "wrap" holding tight. This wrap technique keeps the composite backing tight to the strike surface while allowing all of the benefits of localized fiber movement and tensile failure on the backside of the target. Other high performance fibers, such as fiberglass, also woven in a Leno weave and applied in the same method will yield similar results. This invention also relates to the placement of a "slip layer" on the fiber surface of an armor system.

BACKGROUND OF THE INVENTION

1. Field of the Invention

This invention relates generally to armor systems and more specifically to features of armor structure directed to preventing certain aspects of performance degradation.

2. Background Art

Typically, high efficiency armor (composite-backed armor) that works in a non-supported, or freestanding application suffers from delamination of the composite laminate from the strike face side of the target. This delamination could occur between the composite/frontal structure interfaces, or within the composite laminate itself. This is a very common issue with laminates in high efficiency composite armor as fiber movement and inter-laminar delamination are critical to the performance of the system. Previous attempts at attaching the composite backing involved a stiff wrap or backface structure, or a mechanical through-hole attachment in attempts to control the backface deformation, which reduced the efficiency of the composite backing, or in the case of the through fasteners could create a vulnerable location in the armor system.

In typical armor applications, it is common to have a polymer spray coating on the exterior, which is applied to provide environmental protection and limit spallation of the armor. There is typically a high level of deformation that occurs on the back face of a composite backed armor after a strike with a high-energy projectile. The trauma that results from this high-energy impact may cause composite fibers to deform and break in a tensile failure, leaving a frayed, damaged surface on the backside of the armor even in situations where the threat has been defeated. In previous designs, the polymer "spall liner" coatings would "chunk" off the back and leave the armor at a high velocity upon the impact and resultant trauma that occurs when the fibers break. Polymers with properties favorable for this application (high strength, high elongation) were not able to withstand this event, primarily due to the disintegration of the fibers to which the polymer coating was bonded.

SUMMARY OF THE INVENTION

This invention relates to the use of an open, plain Leno type weave of Aramid fibers (FIG. 3) wrapped around the target in such a fashion that the wrap on the strike face surface is bonded with a thermoset resin while the continuous fibers around the back are left resin-free and able to distort, allowing localized deformation while keeping the remainder of the "wrap" holding tight. This wrap technique keeps the composite backing tight to the strike surface while allowing all of the benefits of localized fiber movement and tensile failure of fibers on the backside of the target. Other high performance fibers, such as fiberglass, also woven in a Leno weave and applied in the same method will yield similar results.

Targets without this composite wrap have suffered from complete structural failure, with the composite portion of the target coming completely delaminated. Targets constructed with this specific wrap technique have been shown to maintain all the efficiencies of a non-wrapped composite backing, while still holding intact for multiple ballistic impacts in close proximity to one another.

This invention also relates to the placement of a "slip layer" between the fiber surface of the armor and the polymer coating. This layer, consists of polytetrafluoroethylene, also known by the acronym PTFE or trade name of TEFLON®, silicone, or other low friction, difficult to bond material. The layer prevents intimate bonding of the polymer coating to the fibers, creating a low friction slip surface that isolates the polymer from the trauma of fiber deformation and breakage.

Targets with coatings applied directly to the fiber surface show the common "chunking" behavior and the resulting damage to witness plates upon testing. Targets with the polymer coating applied over the low friction slip layer showed a completely intact back surface. The trauma and deformation caused by high rate tensile failure of the fibers did not affect the integrity of the polymer coating.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
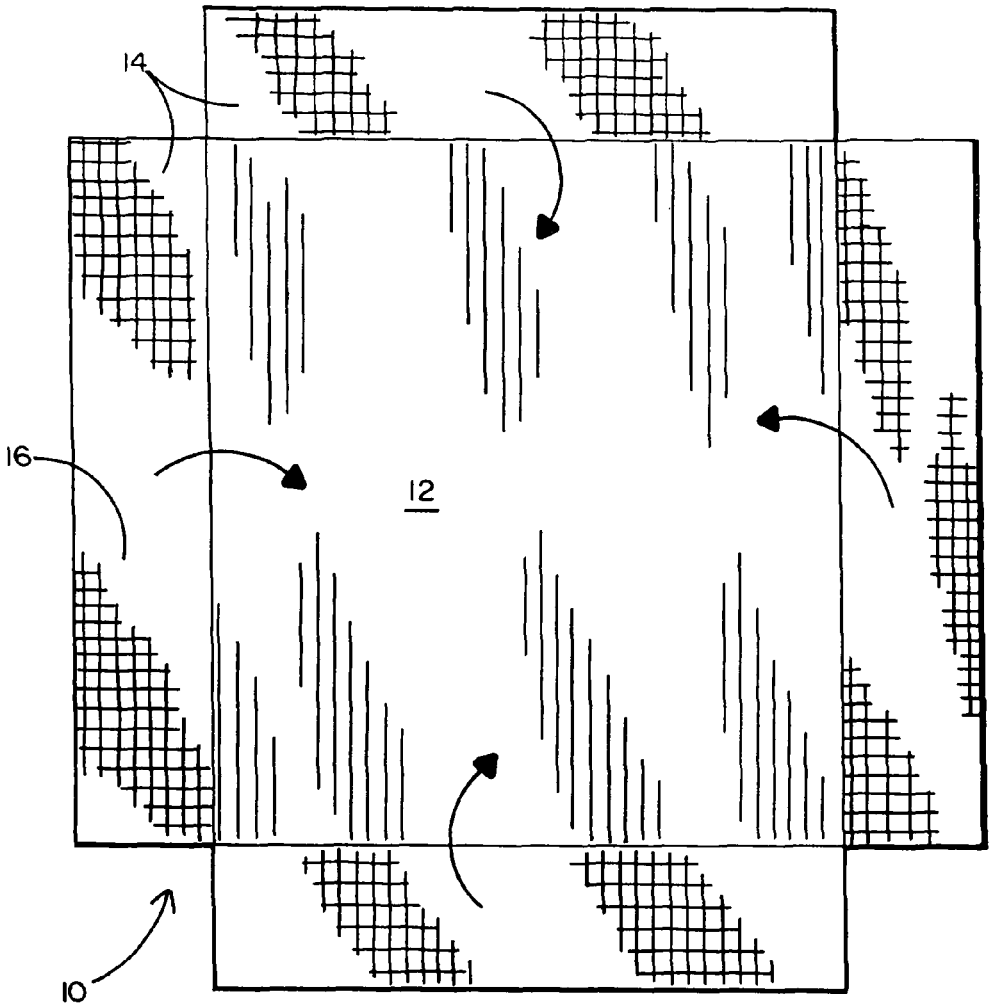
FIG. 1 is a top view of a ceramic armor structure having a fiber wrap, using a thermoset resin to bond only to the top edge surface of the base armor plate while being dry and thus un-bonded on the back and sides of the plate.
Figure 2:
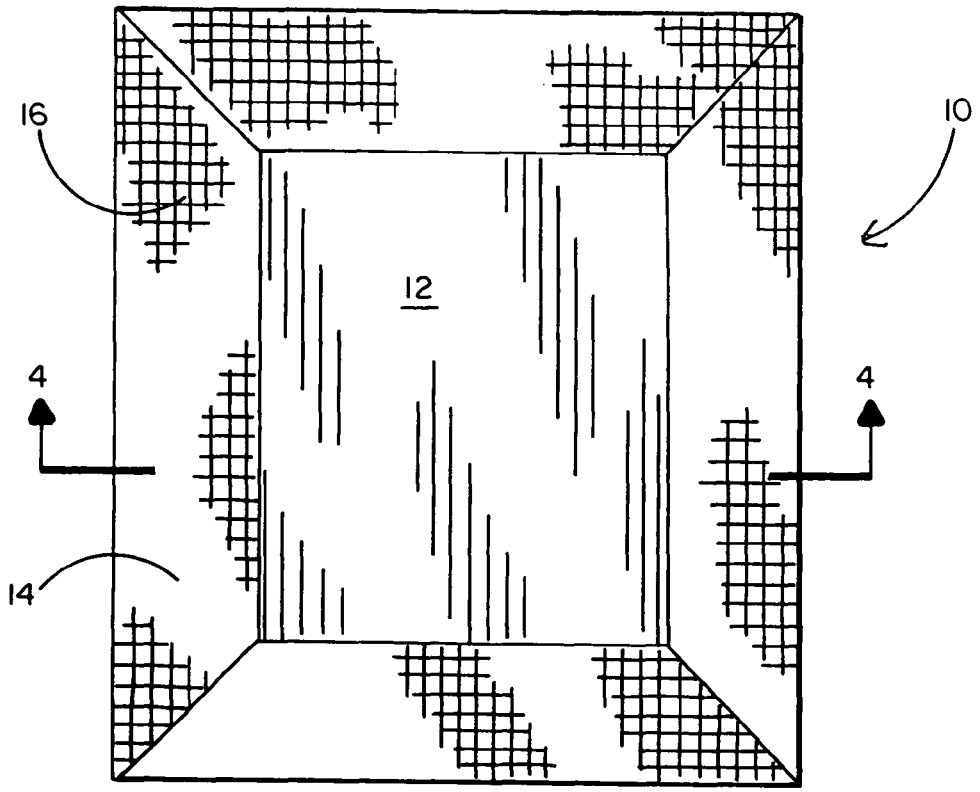
FIG. 2 is a top view of a ceramic armor structure having a fiber weave bonded on the strike face surface, but left resin-free on the back surface to allow local deformation.

Referring to the accompanying drawings and initially to FIGS. 1 to 2, it will be seen that a ceramic armor structure 10 comprises a base armor plate 12 partially surrounded by a backing material made of an Aramid fiber weave 14. Fiber weave 14 is impregnated with a thermoset resin 16 on the overlapped front edges of the armor structure to bond the fiber weave to the underlying base armor plate. On the other hand, the fiber weave on the back and side surfaces of the armor structure 10 is left resin-free and thus able to distort, thereby permitting localized deformation on the back surface while keeping the composite backing tightly adhered to the strike surface. FIG. 1 shows in top view the base armor plate with the fiber weave in a "wrap ear" configuration and FIG. 2 shows the fiber weave folded onto the face armor plate. As seen in FIG. 2, the fiber weave 14 can overlap the side surfaces of the ballistic armor plate 12, but need not cover a portion of the front surface of the ballistic armor plate 12.

Figure 3:
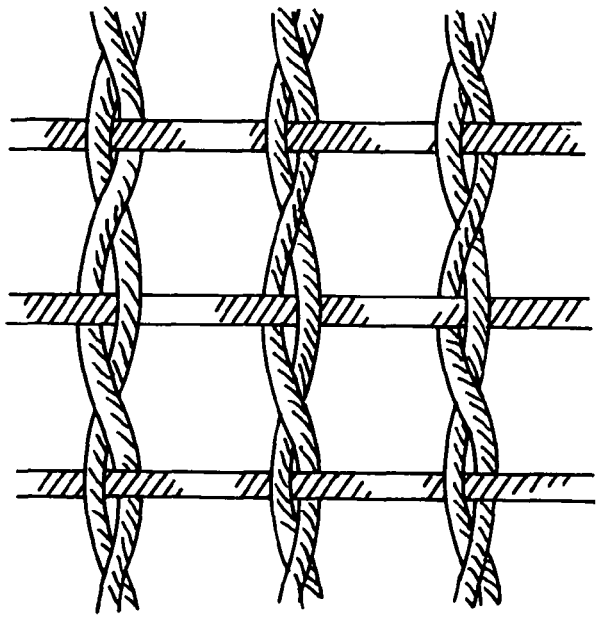
FIG. 3 is an enlarged view of a typical Lena style weave used in the preferred embodiment of the invention.
Figure 5:
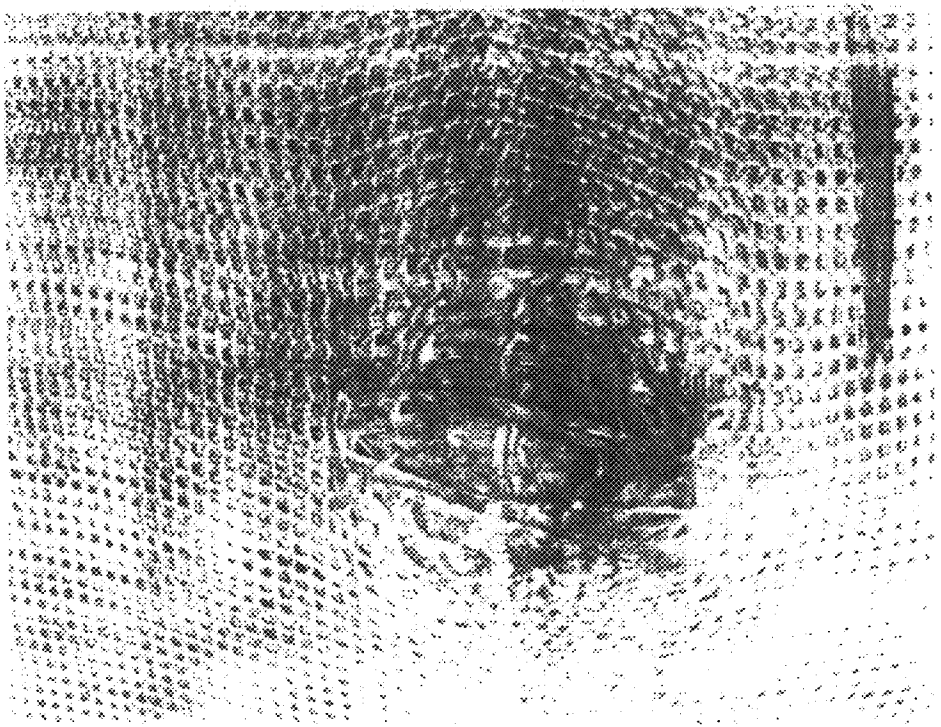
FIG. 5 is a photograph of the wrap fibers locally deforming and breaking thereby allowing the ballistic laminate to locally bulge while keeping the entire laminate attached to the armor plate.

FIG. 3 illustrates the Leno weave style preferred for the backing material. As can be readily observed in FIG. 3, the nature of the Leno weave is such that a dry or resin-free configuration of the backing fiber would readily permit localized fiber movement and tensile failure while permitting the fiber to remain intact on a macro level to resist multiple ballistic impacts in close proximity to one another. Other high performance fibers, such as fiberglass, woven in a Leno weave and applied in the same manner will yield similar results.

Figure 4:
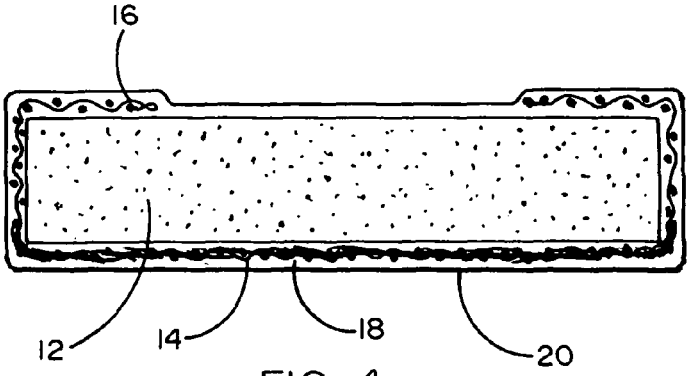
FIG. 4 is a cross-section view taken along lines 4-4 of FIG. 2.

The slip layer feature of the preferred embodiment of the present invention is shown in FIG. 4 to which reference is now made. The slip layer 18 is preferably a bond resistant material such as polytetrafluoroethylene, silicone or other low friction material. Its purpose is to prevent intimate bonding of the polymer coating 20 to the fiber back. FIG. 4 illustrates the slip layer feature in cross-section and shows that the slip layer 18 can be positioned on the back surface on the armor plate 12 and not positioned on the front surface of the armor plate 12. The inner portion of the armor system shown in FIG. 4 consists of the base armor plate. The base armor plate is partially surrounded in a fiber weave in the manner described above in conjunction with FIGS. 1 and 2 or in a more conventional configuration of the prior art. The polytetrafluoroethylene or other low friction slip layer is then applied to the fiber surface. Finally, a polymer such as a polyurea or equivalent environmental coating is applied as the final external layer.

It will now be apparent that what has been disclosed herein comprises an improved armor system wherein a slip layer and a containment wrap tend to preserve the back surface of the armor and permit a local deformation of the back surface fiber weave to better protect a user from delamination and spall liner "chunking". Although a particular embodiment has been disclosed herein, it will be understood that the scope hereof is limited only by the appended claims and their equivalents.

I claim:

1. An armor system comprising:

a ballistic armor plate having from, back and side surfaces;

a ballistic fiber weave overlapping said front surface of said plate and completely covering said back surface of said plate, said ballistic fiber weave on said overlapping front surface being resin impregnated to bond to said armor plate, but being resin-free on said back and side surfaces to remain un-bonded from said armor plate back surface;

wherein the ballistic fiber weave does not cover a portion of the front surface of the ballistic armor plate.

2. The armor system recited in claim 1 further comprising an external environmental polymer coating completely covering said fiber weave.

3. The armor system recited in claim 2 further comprising a slip layer positioned between said fiber weave back surface and said polymer coating.

4. The armor system recited in claim 3 wherein said slip layer is made of a material taken from the group consisting of polytetrafluoroethylene silicone and other bond resistant materials.

5. The armor system of claim 1, wherein the ballistic fiber weave overlaps the side surfaces of the ballistic armor plate.

6. An armor system comprising:

a ballistic armor plate substantially surrounded by a ballistic fiber weave, an external environmental polymer coating completely covering said fiber weave; and a slip layer positioned between said fiber weave and said polymer coating on at least one surface of said armor plate;

wherein the ballistic fiber weave does not cover a portion of the front surface of the ballistic armor plate.

7. The armor system recited in claim 6 wherein said slip layer is made of a material taken from the group consisting of polytetrafluoroethylene silicone and other difficult-to-bond materials.

8. The armor system recited in claim 6 wherein said slip layer is not positioned on a front surface of said armor plate.

9. The armor system of claim 6, wherein the ballistic fiber weave overlaps side surfaces of the ballistic armor plate.

* * * * *